United States Patent [19]

Sumitomo et al.

[11] 4,182,411

[45] Jan. 8, 1980

[54] PLATE TYPE CONDENSER

[75] Inventors: Hiroyuki Sumitomo, Takatsuki; Katsutoshi Fukami; Kazuyuki Kobayashi, both of Nara; Masafumi Doi, Daito; Kenzo Kawanishi, Yao; Keido Yoshida, Osaka, all of Japan

[73] Assignee: Hisaka Works Ltd., Osaka, Japan

[21] Appl. No.: 750,909

[22] Filed: Dec. 15, 1976

[30] Foreign Application Priority Data

| | | | |
|---|---|---|---|
| Dec. 19, 1975 | [JP] | Japan | 50/152364 |
| Feb. 28, 1976 | [JP] | Japan | 51/21550 |
| Feb. 28, 1976 | [JP] | Japan | 51/21551 |
| Feb. 28, 1976 | [JP] | Japan | 51/21552 |
| Feb. 28, 1976 | [JP] | Japan | 51/23684[U] |
| Feb. 28, 1976 | [JP] | Japan | 51/23685[U] |
| Feb. 28, 1976 | [JP] | Japan | 51/23686[U] |
| Mar. 1, 1976 | [JP] | Japan | 51/22488 |

[51] Int. Cl.[2] ..... F28B 9/08

[52] U.S. Cl. ..... 165/110; 165/146; 165/166

[58] Field of Search ..... 165/166, 167, 110, 111, 165/146, 170; 62/285, 288, 289, 290

[56] References Cited

U.S. PATENT DOCUMENTS

| | | | |
|---|---|---|---|
| 2,156,544 | 5/1939 | Raskin | 165/170 |
| 2,285,225 | 6/1942 | Norris | 165/166 |
| 2,586,399 | 2/1952 | Velut | 165/170 |
| 2,587,116 | 2/1952 | Clay | 165/170 |
| 2,596,642 | 5/1952 | Boestad | 165/166 |
| 2,872,165 | 2/1959 | Wennerberg | 165/166 |
| 3,232,341 | 2/1966 | Woodworth | 165/111 |
| 3,430,693 | 3/1969 | Egenvall | 62/290 |
| 3,532,161 | 10/1970 | Lockel | 165/167 |
| 3,840,070 | 10/1974 | Becker et al. | 165/167 |

FOREIGN PATENT DOCUMENTS

| | | | |
|---|---|---|---|
| 2215368 | 10/1973 | Fed. Rep. of Germany | 165/146 |
| 1433379 | 4/1976 | United Kingdom | 165/166 |

*Primary Examiner*—Sheldon Jay Richter
*Attorney, Agent, or Firm*—Hall & Houghton

[57] ABSTRACT

A condenser having heat transmitting surfaces, which comprises two types of heat transmitting plates alternately arranged side by side to define alternate passages for cooling liquid and steam so that the steam is condensed on the heat transmitting surfaces on the steam passage side. The heat transmitting surfaces are formed with grooves and ridges which are recessed in and raised above the base surface, thereby providing a condensate discharging mechanism comprising vertical grooves and inclined grooves for each given region on the condensating and heat transmitting surfaces, and longitudinal grooves are formed between the inclined grooves of said condensate discharging mechanisms.

9 Claims, 21 Drawing Figures

Fig. 14
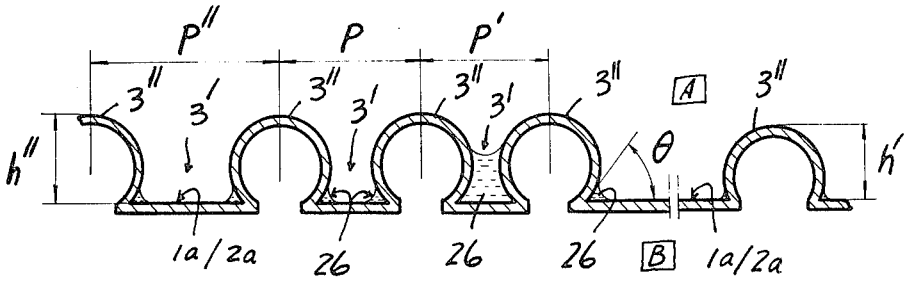
Fig. 18
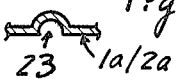
Fig. 20
Fig. 19
Fig. 17
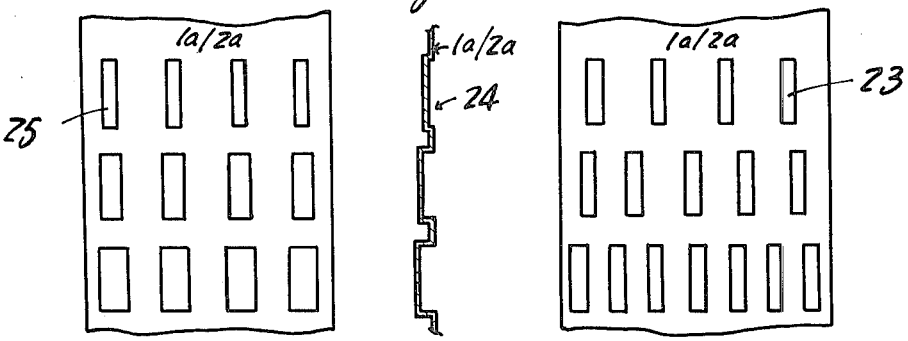
Fig. 21
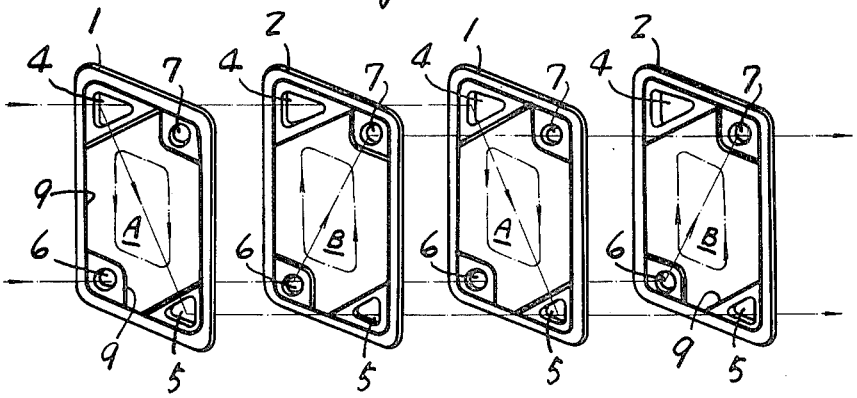

PLATE TYPE CONDENSER

BRIEF DESCRIPTION OF THE INVENTION (a) Field of the Invention

The present invention relates to a condenser having heat transmitting surfaces whose condensate discharging effect is high.

(b) Description of the Prior Art

Generally, of the plate type condensers, many have been developed from the plate type condenser for liquid-to-liquid use only. In improving the heat transmitting performance of such condensers, what becomes a problem is the film coefficient, which is defined as the heat conductivity of the film divided by the thickness of the film and varies with the conditions of the heat transmitting surface, i.e., it varies with how the condensate adheres to the heat transmitting surface. Thus, if steam is fed into a steam passage, a film of condensate is formed on the entire area of the heat trasmitting surface.

As condensation continues to occur, this film becomes gradually thicker and eventually flows down along the vertical heat transmitting surface under its own weight until a thick layer of downflow liquid is formed in the lower region of the heat transmitting surface substantially throughout its width. This downflow liquid becomes gradually thicker toward its lower end and the heat transmitting surface covered with the downflow liquid is prevented from contact with steam and hence the film coefficient in said region is decreased, greatly lowering the heat transmitting performance.

Therefore, in order to improve the heat transmitting performance of the entire heat transmitting surface on which steam condensates, it is necessary to take measures to prevent the thickness of the filmy downflow liquid layer from being increased. In this connection, a condenser having a heat transmitting surface of corrugated sectional shape has been known. It has a heat transmitting surface which is corrugated in cross-section as contrasted with a conventional flat heat transmitting surface and its function is to cause the liquid film forming on the heat transmitting surface to collect in the grooves by making use of surface tension, thereby forming downflow liquid layers only in the grooves. Then, the condensate collected in the grooves will flow down under its own weight and hence the portion of the downflow liquid layer on the heat transmitting surface will be considerably reduced, improving the heat transmitting performance. This is the intended idea.

However, since the amount of condensate increases as it flows down, the condensate drawn to the grooves gradually fills the latter as it flows down, until it overflows and reaches where it forms a thick liquid film. Consequently, the film coenfficient on the heat transmitting surfaces on the downstream side is greately decreased. Further, even if the volume of the midstream portion of such groove is adapted to the amount of the inflow condensate, the amount of the condensate flowing into the groove in the upstream is small as compared with the volume of the groove, so that a relatively thin film of condensate is formed in the groove, decreasing the concentration effect of condensate. And, since the area required is large for the amount of the downflow condensate, it is impossible to allocate a sufficient area to the effective heat transmitting surface, thus lowering the heat transmitting efficiency.

Further, since the upstream side has the effect of forcing the condensate to flow down by the action of the flowing steam, the number of grooves required is not large and moreover, the unevenness of the heat transmitting surface due to the presence of many grooves increases the pressure loss of steam, reducing the effect by half.

SUMMARY OF THE INVENTION

In view of the above circumstances in the conventional condenser, it is an object of the invention to provide a novel construction for the heat transmitting surface which makes it possible to provide a condenser having a high film coefficient. Basically, it consists of two principles for effectively discharging condensate, one of which is to form grooves and ridges on a heat transmitting surface, thereby providing the condensating and heat transmitting surface with condensate collecting and discharging mechanisms (water collectors), while forming longitudinal grooves directed downstream between said condensate collecting and discharging mechanisms, so that the condensate flowing down the longitudinal grooves is collected and discharged before its amount increases to the extent that it overflows the longitudinal grooves. The other principle is to make the capacity of the longitudinal groove for accommodating condensate proportional to the amount of downflow condensate, which means that the longitudinal grooves are divided into suitable lengths distributed over the heat transmitting surface, the width or depth of such grooves or the number of them per unit width of the heat transmitting surface being adjusted to provide a desired capacity for accommodating condensate.

FEATURES OF THE INVENTION

Condensate which forms on the condensating and heat transmitting surface is drawn into the longitudinal grooves between the water collectors by surface tension and flows together to be effectively collected and discharged. Therefore, the ratio of the effective heat transmitting surface area to the entire heat transmitting surface area is stably maintained high, so that the film coefficient on the heat transmitting surface is improved as a whole.

Further, the capacity of the longitudinal grooves for accommodating condensate is proportional to the amount of condensate being formed and flowing down in the respective downstream regions to assure that the effective heat transmitting surface for condensing steam and the longitudinal grooves and water collectors for collecting and discharging condensate will function effectively to improve the film coefficient. Thus, a condenser which is superior in heat transmission is obtained.

BRIEF DESCRIPTION OF THE DRAWINGS

FIGS. 7 through 12 show examples of the water collector (inclined groove), in which FIGS. 7 and 10–12 are vertical sections of heat transmitting plates, FIG. 8 is a front view of a heat transmitting plate, and FIG. 9 is a cross-sectional view of a heat transmitting plate;

FIGS. 13 through 16 show examples of a longitudinal groove; in which FIGS. 13 and 14 are cross-sectional views of longitudinal grooves formed in heat transmitting plates, FIG. 15 is a longitudinal section of a longitudinal groove, and FIG. 16 is a perspective view of a longitudinal groove;

FIGS. 17 through 20 show another example of the heat transmitting plate construction, in which FIGS. 17 and 20 are front views, FIG. 18 is a cross-sectional view of longitudinal grooves in FIG. 17, and FIG. 19 is a longitudinal section of a heat transmitting plate; and FIG. 21 is a view for explaining how steam and cooling liquid flow in a condenser constructed according to the invention.

DESCRIPTION OF THE PREFERRED EMBODIMENTS

Figure 2:
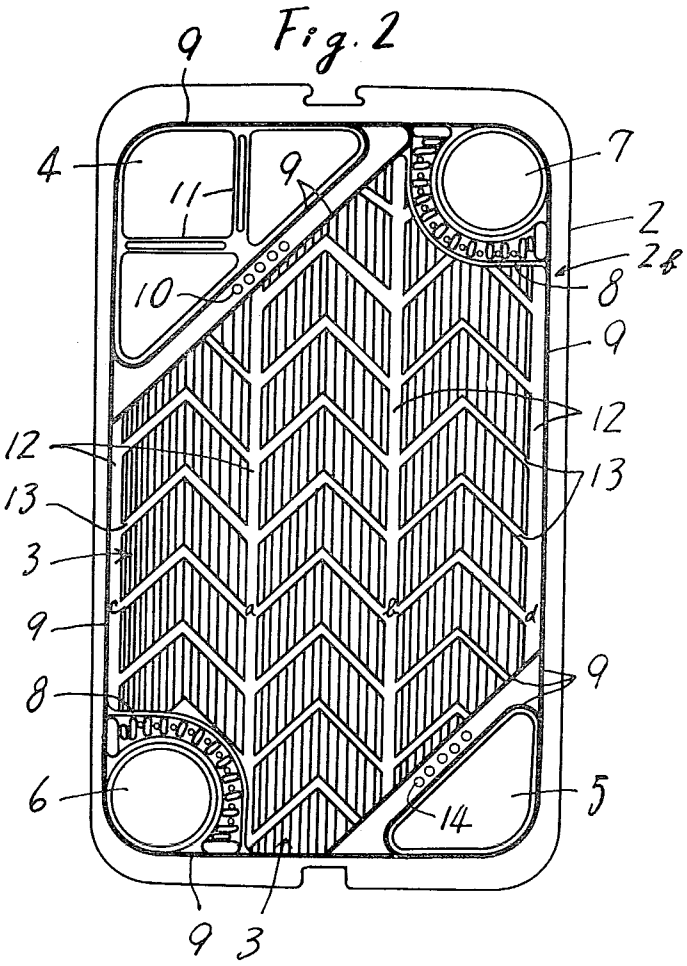
FIGS. 1 and 2 are front views of two types of heat transmitting plates according to the present invention.
Figure 1:
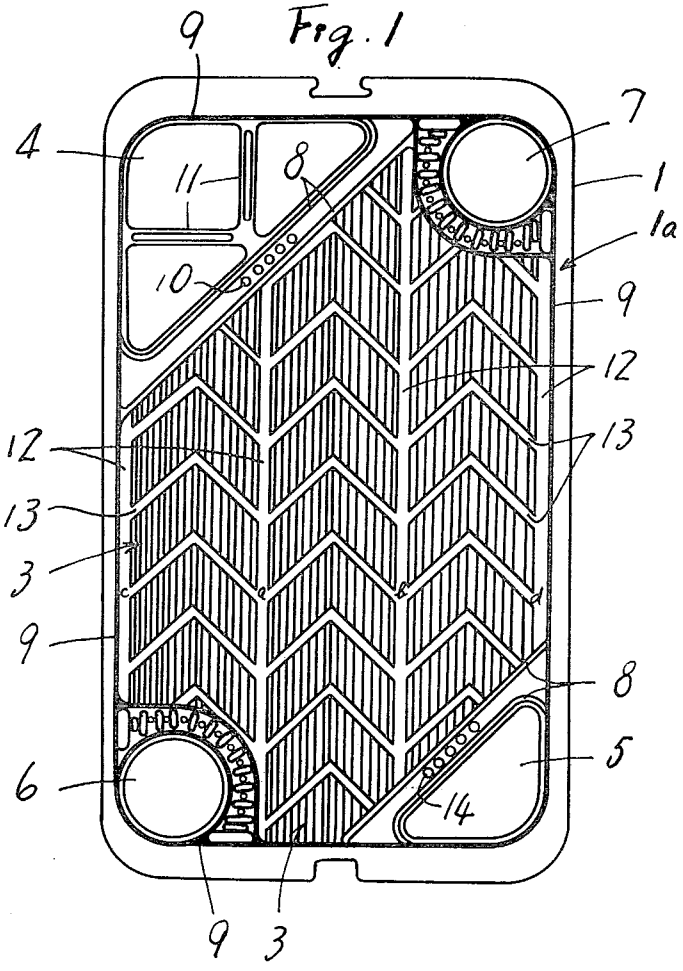
Figure 4:
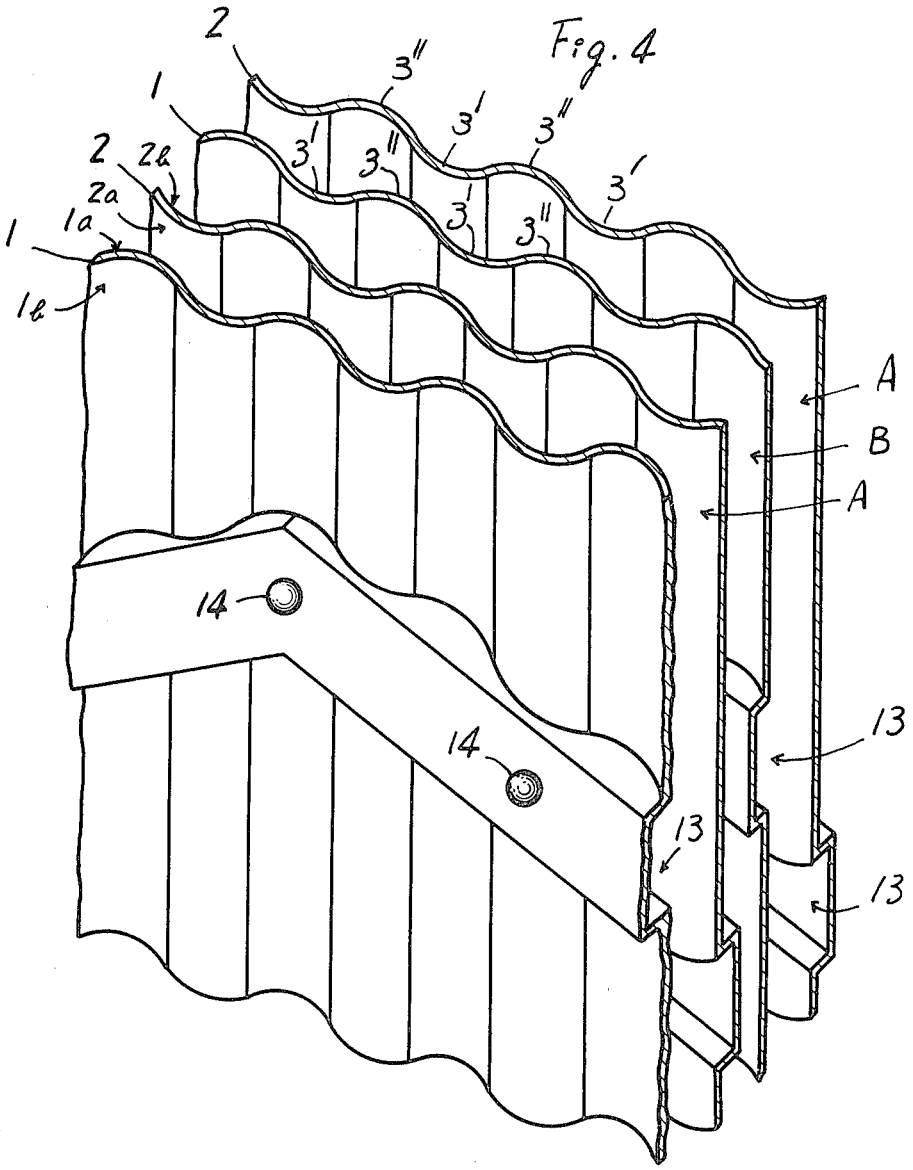
FIG. 4 is a fragmentary perspective view showing said two types of heat transmitting plates arranged side by side.
Figure 5:
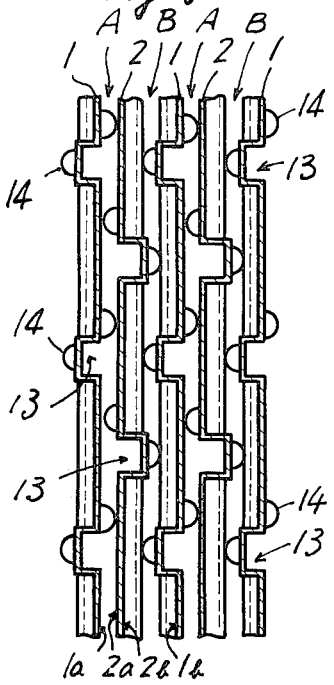
FIG. 5 is a side view, in section, of said plates.
Figure 6:
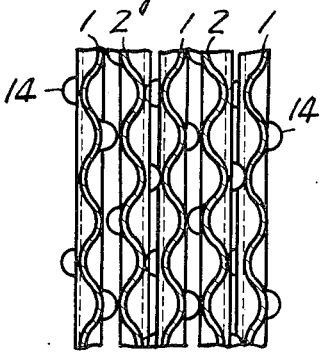
FIG. 6 is a cross-sectional view of said plates.

The constructions of two types of adjacent heat transmitting plates according to the present invention are designated at 1 and 2 in FIGS. 1 and 2. These two types of heat transmitting plates 1 and 2 are alternately arranged side by side in such a manner that, as shown in FIGS. 4 through 6, a steam passage A are defined between the front surface 1*a* of the heat transmitting plate 1 and the back surface 2*a* of the heat transmitting plate 2 while a cooling liquid passage B are defined between the back surface 1*b* of the heat transmitting plate 1 and the front surface 2*b* of the heat transmitting plate 2. The steam passages A and cooling liquid passages B alternate with each other. These heat transmitting plates 1 and 2 have an inlet 4 and outlet 5 for gas and an inlet 6 and outlet 7 for liquid at their respective four corners. Thus, pairs of inlets and outlets 4, 5, 6, 7 are disposed on the diagonal lines on the heat transmitting plates. The inlet and outlet 4 and 5 for gas are made triangular by making use of corners of the heat transmitting plate, but the inlet 4 is larger than the outlet 5. The inlet and outlet 6 and 7 for liquid are circular and same in diameter. Designated at 8 is a packing groove extending to surround the peripheries of said four inlets and outlets and the effective heat transmitting portion. A packing 9 is shown in a thick line which is fitted in the packing groove 8 whereby a steam passage A is defined in the heat transmitting plate 1 and a cooling liquid passage B in the heat transmitting plate 2. Designated at 10 are projections disposed around the peripheries of the gas inlet and outlet for reinforcing the peripheries of the inlet and outlet. Designated at 11 are mechanisms for reinforcing the gas inlet 4 of large size.

Water collectors consist of vertical grooves 12 and inclined grooves 13 and are provided on the heat transmitting plate to open to the steam passage A. In addition, the illustrated example shows a press formation. The water collectors, 12, 13, are arranged as follows: At positions a and b dividing the effective heat transmitting surface of the heat transmitting plate into three equal parts and at opposed lateral positions c and d, the vertical grooves 12 are disposed while between the positions a and c, a and b, and b and d the oppositely inclined grooves 13 are joined together at their tops with their downward ends opening to the vertical grooves 12. In addition, in the illustrated example the water collectors are press worked to provide grooves which are square or rectangular in cross section. However, they may be any other form, provided that they can collect the condensate and discharge it to the outside of the system. For example, L-shaped angle members may be attaced by welding.

Figure 3:
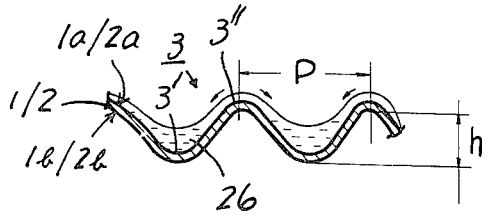
FIG. 3 is a partial cross-sectional view of such heat transmitting plate, showing the action of longitudinal grooves.

Between the inclined grooves 13, there are longitudinal grooves 3 which extend in the dirction of flow of the condensate and have their lower ends opening to the inclined grooves 13. The longitudinal grooves 3, as shown in FIG. 3, allow the condensate 26 on the crests 3″ to be collected in the bottoms 3′ by surface tension, thereby reducing the layer of flowing condensate on the crests 3″ and improving the film coefficient on the condensating and heat transmitting surface 1*a* or 2*a* as a whole. In addition, the longitudinal grooves 3 shown in FIG. 3 have a continuous wavy cross-sectional shape, but they are not limited thereto. For example, they may be triangular, and it does not matter whether they are continuous or discontinuous. As for the height of the longitudinal grooves, if the relation between their spacing p and height h is selected so that $p/h \leqq 3.5$, a satisfactory result will be obtained.

Designated at 14 are projections distributed over the heat transmitting surface, and, as can be seen from FIG. 5, they serve to maintain a given spacing between the heat transmitting plates 1 and 2 and also serves for reinforcement.

The flow condition of steam and cooling liquid in the heat transmitting plates alternately arranged side by side is as shown in FIG. 21. Thus, steam flowing in through the gas inlet 4 in the upper region flows down in the steam passages A, during which it is cooled and condensated by the coolant in the cooling passages B, and the resulting condensate flows down in the longitudinal grooves, inclined grooves and vertical grooves in the manner described above and is discharged through the gas outlet 5 into the outside of the system. On the other hand, the cooling liquid enters the inlet 6 in the lower region and flows upwardly through the cooling liquid passages B and is discharged into the outside of the system through the liquid outlet 7 in the upper region.

Other examples of said inclined groove will now be described with reference to FIGS. 7 through 12.

Figure 7:
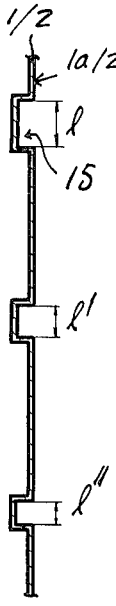

Inclined grooves 15 shown in FIG. 7 are obliquely provided in several rows in the condensating and heat transmitting surface 1*a* or 2*a* and an upper inclined groove has a greater width than a lower one, as indicated at 1, 1′ and 1″. In this case, the inclined grooves have an equal depth. Thus, the inclined grooves 15 are increased in their liquid accommodating capacities as the upper region is approached, or conversely, their liquid accommodating capacities are stepwise decreased as the lower region is approached This design takes into consideration the fact that the amount of steam condensate is increased as the upper region of the heat transmitting surface is approached and that, therefore, a greater amount of condensate flows into an upper inclined groove than into a lower one. Thus, in this design, the width of the inclined grooves 15 is made to agree with the associated amount of condensate flowing thereinto.

Figure 8:
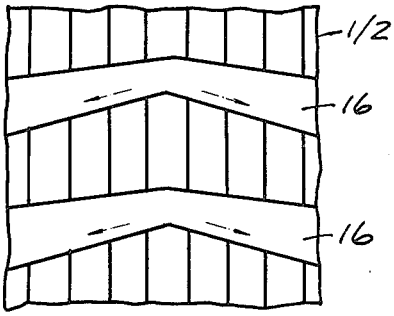

FIG. 8 shows inclined grooves 16 whose width is gradually increased as the downstream side is approached. This design takes into consideration the fact that the condensate flowing into the upstream region of each inclined groove is increased in amount as it flows down. Thus, the width of the inclined grooves 16 is gradually increased as the downstream region is approached, thereby increasing the liquid accommodating capacity.

Figure 10:
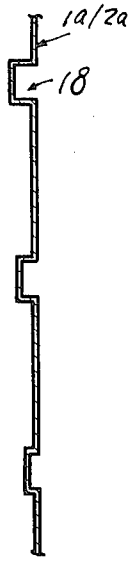
Figure 9:
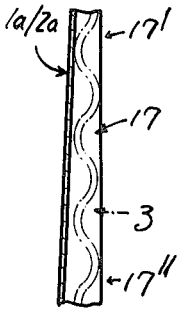

In the two examples described above, the width of the inclined grooves 15 and 16 is varied to agree with the amount of inflow condensate. However, it is also possible to vary the depth while maintaining the width unchanged. This is shown in FIG. 9, the depth of an inclined groove 17 is gradually increased from the upstream region 17' toward the downstream region 17''. Therefore, the liquid accommodating capacity of the inclined groove 17 is increased as the downstream region is approached, agreeing with the amount of inflow condensate. FIG. 10 shows such inclined grooves 18 as an upper inclined groove has greater depth than a lower one.

In brief, according to the four examples shown in FIGS. 7 through 10, the width or depth of the inclined grooves 15, 16, 17 and 18 is changed so that their local liquid accommodating capacity agrees with the amount of the liquid flowing into that local area, thereby preventing a lowering of film coefficient due to a flood of condensate in the downstream portion of an upper inclined groove where there is a larger amount of condensate flowing in. In this connection, the form is not limited to those shown in these examples.

Figure 11:
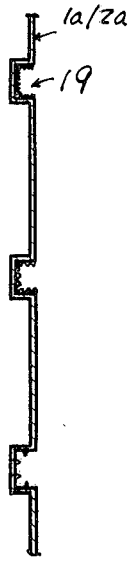

An example shown in FIG. 11 has a construction which strengthens the adhesion of condensate to inclined grooves 19 according to the windage pressure of steam flow, thereby eliminating the influence of the windage pressure. Thus, an inclined groove located at a higher position where the windage pressure of steam flow is higher has its condensate channel surface more highly roughened. Such surface roughening may be effected by washing with acid, and the degree of roughening should be such as to prevent the condensate from being forced to flood the condensating and heat transmitting surfaces at lower positions by the windage pressure of steam flow, while allowing the condensate to easily flow down along the inclined grooves 19. For example, the surface may be roughened in the form of fine oblique grooves parallel with the direction of inclination of the inclined grooves 19. In addition, as for those inclined grooves which are located at lower positions, it is not absolutely necessary to roughen them since the influence of the windage pressure of steam flow is smaller.

Figure 12:
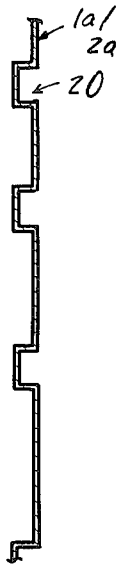

FIG. 12 shows an arrangement wherein the spacing between inclined grooves 20 is varied so as to prevent the thickening of the layer of condensate on the condensating and heat transmitting surface 1*a* or 2*a*. More particularly, in view of the fact that the amount of condensate which forms per unit length decreases from upstream to downstream regions in a heat transmitting surface, the illustrated arrangement is designed so that the spacing between the inclined grooves 20 increases from upstream to downstream regions. With the spacing between the inclined grooves 20 varied in this manner, the condensate can be discharged before the film of condensate becomes thick enough to aggravate the film coefficient, and since it is only necessary to dispose a necessary minimum number of inclined grooves at the necessary positions, the pressure loss due to the presence of the inclined grooves can be minimized. Thus, there is obtained a heat transmitting surface which develops a superior heat transmitting performance.

Other examples of the longitudinal groove will now be described with reference to FIGS. 13 through 16.

The action of the longitudinal grooves 3, as previously described with reference to FIG. 3, is to collect the condensate 26, which forms on the condensating and heat transmitting surface 1*a* or 2*a*, in the longitudinal groove bottoms 3' by making use of surface tension and allow it to flow down, thereby lessening the thick portion of the flowing layer of condensate to improve the heat transmitting performance. As for the relation between the spacing p of the longitudinal grooves and the difference h in the level between the bottoms 3' and crests 3'' of the longitudinal grooves, it has been found that, in the case of a heat transmitting surface formed by press working $p/h \approx 3.1$ is best.

Figure 13:
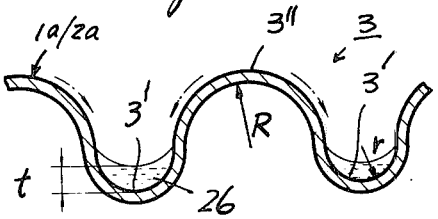

FIG. 13 shows an arrangement in which the radius of curverture r of the bottoms 3' of longitudinal grooves 3 formed in a heat transmitting surface in a continuously connected wavy form is smaller than that R of the crests 3''. According to this arrangement, since the arc ($\approx \pi r$) of the flow-down channel for the condensate is smaller than the arc ($\approx \pi R$) of the condensating and heat transmitting portion, the flow-down thickness t of the collected condensate is increased as compared with the conventional arrangement having no change in the arcs of the crest and bottom, under the same conditions, i.e., when the flow-down amount of condensate is same. Therefore, the condensate collecting effect of the bottoms 3' is high and the effective heat transmitting area of the crests 3' having no or thin film of condensate formed thereon is increased, thereby improving the heat transmitting performance. The ratio of the arcs of the bottoms 3' and crests 3'' should be suitably set according to the amount of condensate being formed on the heat transmitting surface. For example, the difference between the bottom radius r and the crest radius R may be made greater so as to decrease the ratio of the area of the condensate flow-down channel to the condensating and heat transmitting surface of the crests 3''. This is applied particularly when the amount of condensate being formed is small. Further, it is not absolutely necessary for the cross-sectional shape of the bottoms 3' and crests 3'' of the longitudinal grooves to take the form of an arc of a true circle as shown. The results described above can be obtained if the crests and bottoms are defined by arcs and the crests are larger than the bottoms. In addition, it is also possible to increase the capacity for discharging condensate by making the respective arcs larger than the corresponding semicircles.

In an arrangement shown in FIG. 14, an angle $\theta$ formed between the arc of a crest 3'' and the heat transmitting base surface 1*a* or 2*a* when the crest 3'' projecting on the steam passage A side extends downwardly toward the cooling liquid passage B side. This is intended to increase the capacity of longitudinal grooves for collecting and holding condensate. As a result, the layer of condensate on the condensating and heat transmitting surface can be thinned and hence that portion of the heat transmitting area along which condensate flows down can be decreased, thereby contributing to the promotion of heat transmitting efficiency.

Further, by adjusting the degree of said angle $\theta$ as by varying the level of the crests 3'' above the base surface in such a manner that a decreased height h' is employed in the upstream region while an increased height h'' is employed in the downstream region, it is possible to make the capacity of the longitudinal grooves for accommodating condensate agree with the amount of condensate flowing down. Further, by adjusting the spacing p between the longitudinal grooves, it is also possible to increase that portion of the total heat transmitting area which is not covered with a thick film of condensate and which, therefore, provides a high heat transmitting efficiency. More particularly, in the case of a short spacing p', even if the amount of condensate 26 collected increases to the extent of filling the heat transmitting base surface 1*a* or 2*a*, the condensate accommodating capacity will not be lowered. If a long spacing p'' is used, the condensate on the heat transmitting base surface 1*a* or 2*a* corresponding to bottom 3' is attracted to the condensate 26 collected at the root leading to the crest, so that this heat transmitting base surface also functions as an effective heat transmitting surface.

Figure 15:
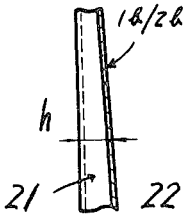
Figure 16:
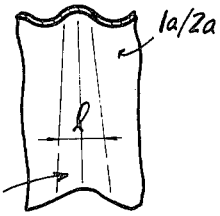

FIGS. 15 and 16 show longitudinal grooves 21 and 22 whose liquid accommodating capacity is gradually increased toward the downstream region. Thus, the depth h or width l of the longitudinal grooves 21 and 22 is varied according to the amount of liquid collected, thereby preventing the condensate from flooding the longitudinal grooves 21 and 22.

Another construction of the heat transmitting surface will now be described with reference to FIGS. 17 through 20.

FIG. 17 is a front view of a portion of a condensating and heat transmitting surface 1*a* or 2*a*. In this arrangement, the widths of longitudinal grooves are varied so as to vary the condensate accommodating capacities of the longitudinal grooves. The longitudinal grooves 23 are marked off to a fixed length and have the same depth and there is no difference in the number of longitudinal grooves between the upstream and downstream regions, but the widths of the grooves are widened as the downstream region is approached. In other words, the condensate accommodating capacity is increased as the downstream region is approached. In addition, the longitudinal grooves may be wave or angle shaped or may have any other shape. For example, they may have a shape shown in FIG. 18 which is a cross-sectional view of the longitudinal groove 23.

Further, FIG. 19 is a longitudinal section of the heat transmitting plate 1 or 2, wherein longitudinal grooves 24 have different depths. These longitudinal grooves 24 have the same width and there is no difference in the number thereof between the upstream and downstream regions, but their depths become greater toward the downstream region so that their condensate accommodating capacities agree with the amount of condensate flowing down.

In an arrangement shown in FIG. 20, the number of longitudinal grooves 25 is varied to vary the condensate accommodating capacity. In this case, there is no variation in the width or depth of grooves 25, but as the downstream region is approached, the number of grooves per lateral length is increased so that the condensate accommodating capacity is proportional to and agrees with the amount of condensate being formed.

When the capacity of the longitudinal grooves 23, 24 and 25 for accommodating condensate is proportional to and agrees with the amount of condensate being formed and flowing down, as described, the effective heat transmitting surface and longitudinal grooves individually function effectively. Thus, a heat transmitting surface having a superior heat transmitting performance is obtained.

Further, the following merit is also found: With such heat transmitting surface having discontinuous longitudinal grooves, the condensate formed is concentrated in longitudinal grooves and then flows down in such a manner that whenever a certain amount of condensate collects, it overflows the terminal edge of the longitudinal groove, but such overflow is intermittent in that the condensate drips in fixed successive amounts, with the force of fall due to gravity downwardly gushing the condensate and adding momentum to the condensate which has flowed into grooves, thereby increasing the flow-down efficiency.

In addition, while the condensate accommodating capacity has been shown varied for every fixed length, such lengths may be different and it is not absolutely necessary that the initial and terminal ends be respectively aligned.

While the description given so far has been directed to a plane form of heat transmitting surface the invention is, of course, applicable to condensers having other forms of heat transmitting surfaces, such as spiral and tubular, while achieving similar merits, without departing from the spirit of the invention. Further, the shapes of the longitudinal grooves and inclined grooves are not limited to those illustrated herein and it is obvious to those skilled in the art that many variations are possible within the scope of the invention.

We claim:

1. A rectilinear plate type condenser construction comprising two types of heat transmitting plate elements arranged in side by side relationship to define alternate passageways therebetween, one passageway being for the passage of a cooling liquid therethrough and the other for the passage of steam therethrough in countercurrent flow to the cooling liquid so that the steam will be condensed on the heat transmitting surface of the steam side of one of the transmitting plate elements, each of said plate surfaces having a plurality of first vertical channels extending in right angle relationship to the top edge of the plate element and in widely spaced, lateral relationship to one another formed thereon, a plurality of vertically spaced, inclined channels formed therein between said first channels with the lower end of each of said inclined channels merging into at least one of said first vertical channels, and a plurality of laterally spaced second vertical grooves formed thereon between each of said first widely spaced vertical channels in parallel relationship thereto, said plurality of second vertical channels extending between and connecting one inclined channel to the next succeeding inclined channel, said vertical and inclined channels forming a condensate discharging means for each given region on each of the condensing and heat transmitting plate surfaces of each plate element.

2. A rectilinear plate type condenser in accordance with claim 1, wherein each of said vertically spaced, inclined channels in each of the plate surfaces is A-shaped in configuration having one part of each inclined channel extending from substantially the midpoint between the first vertical channels downwardly in an inclined direction to one vertical channel and the other part of the inclined channel extending from the said mid-point downwardly in an inclined direction towards the next adjacent first vertical channel, thereby permitting the condensate collected on each plate surface to flow into two vertical channels.

3. A rectilinear plate type condenser construction in accordance with claim 1, characterized in that the capacity of said inclined channels for receiving the condensate is varied in proportion to the amount of inflow collected liquid.

4. A rectilinar plate type condenser construction in accordance with claim 1, wherein the inclined channels at higher positions on the heat transmitting plate surface have their condensate channel surfaces successively more roughened than the inclined channels at lower positions on the plate surface.

5. A rectilinar plate type condenser construction in accordance with claim 1, wherein a plurality of the inclined channels in said plate surface have their spacing gradually increased toward the downstream side of said condenser construction.

6. A rectilinar plate type condenser construction in accordance with claim 1, wherein the arc of the crest of a vertical channel projecting to the steam passage side is larger than the arc at the bottom thereof.

7. A rectilinar plate type construction in accordance with claim 1, wherein the angle formed between the arc of the crest of a second vertical channel and the heat transmitting base surface when the crest, which projects to the steam passageway side, downwardly extends toward the cooling liquid passageway side, is an acute angle.

8. A rectilinar plate type condenser in accordance with claim 1, wherein the capacity of said second vertical channels for accommodating condensate is gradually increased towards the downstream side.

9. A rectilinear plate type condenser construction in accordance with claim 1, wherein said second vertical channel grooves are discontinuous and are distributed over the heat transmitting plate surfaces and their capacity for accommodating the condensate is intermittently increased as the condensate flows down.

* * * * *